US005273194A

United States Patent [19]

McNamara

[11] Patent Number: 5,273,194

[45] Date of Patent: Dec. 28, 1993

[54] BEVERAGE SERVER

[75] Inventor: George E. McNamara, Minneapolis, Minn.

[73] Assignee: Service Ideas, Inc., Minneapolis, Minn.

[21] Appl. No.: 966,087

[22] Filed: Oct. 23, 1992

[51] Int. Cl.[5] ..... A47G 19/12; B65D 83/00

[52] U.S. Cl. ..... 222/470; 220/324; 220/321; 222/472; 222/548; 222/550; 222/556

[58] Field of Search ..... 222/465.1, 475.1, 470, 222/472, 473, 153, 548–550, 552, 554, 556, 562, 563; 220/324, 331; 215/237

[56] References Cited

U.S. PATENT DOCUMENTS

| | | | |
|---|---|---|---|
| 569,351 | 10/1896 | Putnam | 222/470 X |
| 1,248,598 | 12/1917 | Baron | 222/470 |
| 2,287,582 | 6/1942 | Weeks | 222/470 |
| 2,493,109 | 1/1950 | Coleman | 222/470 X |
| 2,805,561 | 9/1957 | Emmert et al. | 222/472 X |
| 3,028,034 | 4/1962 | Freiman | 222/472 X |
| 3,189,229 | 6/1965 | Carroll et al. | 222/465.1 X |
| 3,321,115 | 5/1967 | Rendahl | 222/473 X |
| 3,362,590 | 1/1968 | Martin | 222/465.1 |
| 3,632,025 | 1/1972 | Bloomfield | 222/472 |
| 5,036,993 | 8/1991 | Ramsey | 222/472 X |

FOREIGN PATENT DOCUMENTS

| | | | |
|---|---|---|---|
| 3603528 | 7/1987 | Fed. Rep. of Germany | 222/475.1 |
| 7215 | of 1896 | United Kingdom | 222/472 |

*Primary Examiner*—Kevin P. Shaver
*Attorney, Agent, or Firm*—Moore & Hansen

[57] ABSTRACT

There is provided a beverage server comprising a pitcher and a multiple positionable lid. The lid is capable of being disposed in three distinct positions on the pitcher, including a filling position, a pouring position, and a locked position wherein beverage is substantially prevented from being spilled from the pitcher.

23 Claims, 3 Drawing Sheets

BEVERAGE SERVER

BACKGROUND OF THE PRESENT INVENTION

Beverage servers are an ubiquitous commodity of the restaurant industry. Typically they include a pitcher for containing a beverage and a lid that is attached thereto in some manner and that opens to allow filling of the pitcher and pouring therefrom. Often the pitcher will have a double walled construction that includes an insulating material to keep the contained beverage hot or cold as desired.

One problem with many prior art beverage servers is that hot beverages can be easily spilled from them. Thus, if a beverage server is upset, the lid can open and allow the beverage to spill out. This spillage wastes not only the beverage but can also directly cause injuries if a hot beverage is spilled onto a person. Indirect injuries may occur to people due to their attempts at avoiding the spilling beverage or later slipping and falling if the beverage should spill onto the floor. In either case, the prepared food merchandiser faces potential economic losses whenever a spill occurs due to payment of damages for any injuries as well as the loss of business because of unhappy customers.

Restaurants are not the only locations where such beverage servers are found. Many of the presently available types of servers have also found their way into the home and work place. The dangers related to an unsealed server and spills therefrom in the restaurant industry are also applicable to their use in the home or work place. While devices that provide a sealed container are presently being sold, such as beverage servers having a screw-on lid, they are often difficult for certain segments of the population to use, such as children or individuals who have a loss of hand flexibility or strength and are therefore not acceptable for use in the home, work place or restaurant generally. Additionally, because of the time involved in sealing and unsealing the lids, they are not practical or economical to use in a busy environment such as a restaurant where it is more desirable to have waiters dispensing prompt service to the waiting customer than spending time sealing and unsealing server lids.

It would be desirable, therefore, to have a beverage server having a lid capable of sealing onto the pitcher to prevent accidental spills that is simple to use and that requires a minimum of hand strength and flexibility and a minimum of time to use.

SUMMARY OF THE PRESENT INVENTION

It is a principal object of the present invention to provide new and improved article that is not subject to the foregoing disadvantages.

It is another object of the present invention to provide a beverage server having a sealable lid that is easily and simply moved between sealing and unsealing positions.

It is yet another object of the present invention to provide a beverage server having an easily movable, multiple positionable lid including a sealing portion to prevent accidental spillage and injuries to persons and property.

An improved beverage server comprising a pitcher and a lid capable of multiple positions with respect thereto is described and claimed herein.

The pitcher is defined by a body portion for holding a beverage and by a neck portion for filling and emptying the pitcher. The neck includes a guide rail extending across an opening into the pitcher; the guide rail divides the opening into a spout opening and an accurate guide gap.

The multiple-positionable lid allows for selectively filling the pitcher with a beverage, pouring a beverage from the pitcher, and for sealingly closing the pitcher to prevent spills. The lid includes a dome shaped cover having a stopple depending downwardly therefrom. As arcuate guide post having a hook at the end thereof depends downwardly from the cover and is configured for removable insertion into the guide gap of the pitcher. The lid is rotatable on the pitcher to limits defined by the interference of the guide post with the guide rail or its neck supports. Locking means are provided to lock the lid onto the pitcher to prevent spillage of the beverage. The lid is pivotally openable to pour a beverage from the pitcher.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
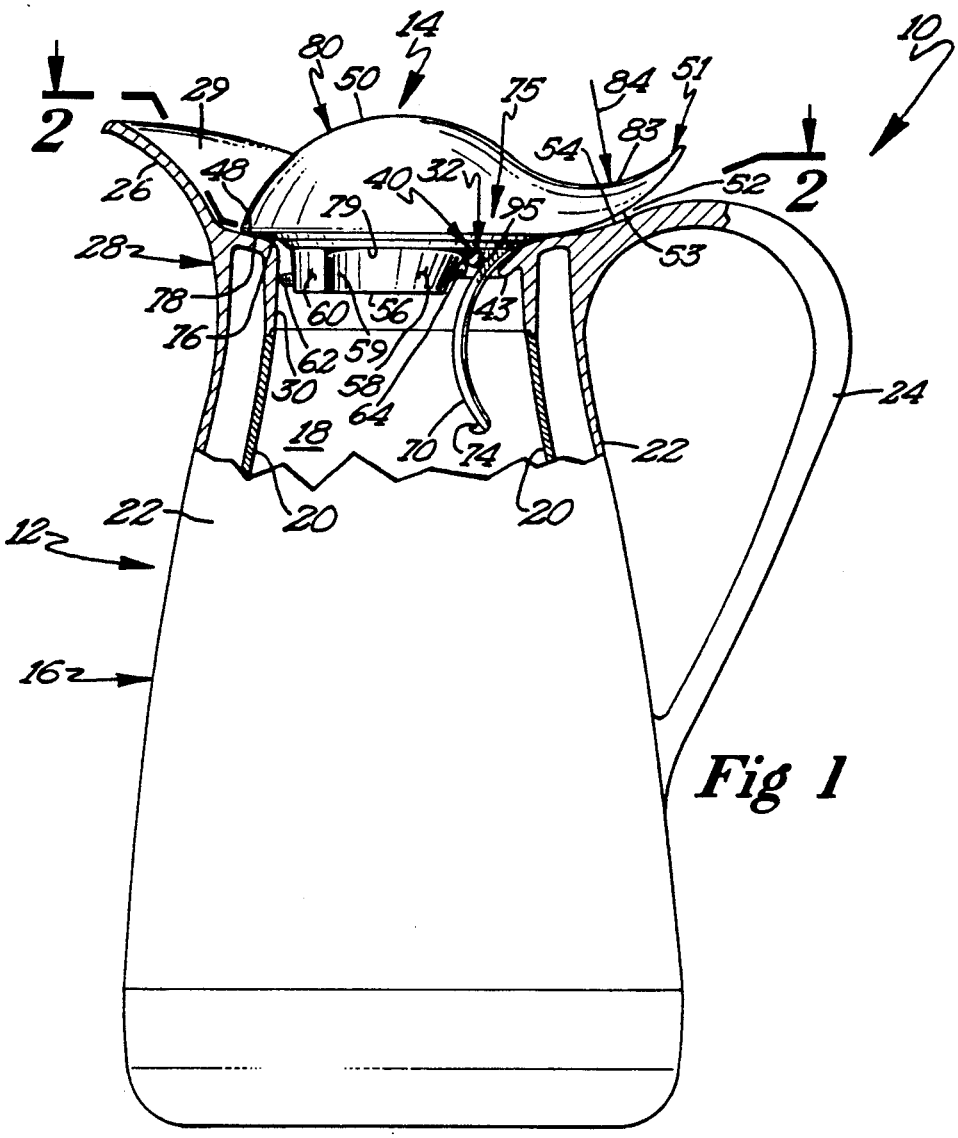
FIG. 1 illustrates a beverage server in accordance with the present invention wherein the pitcher is shown in a side elevation, partial cross sectional view and the lid is shown disposed relative thereto in an operative position for pouring a beverage from the pitcher.
Figure 2:
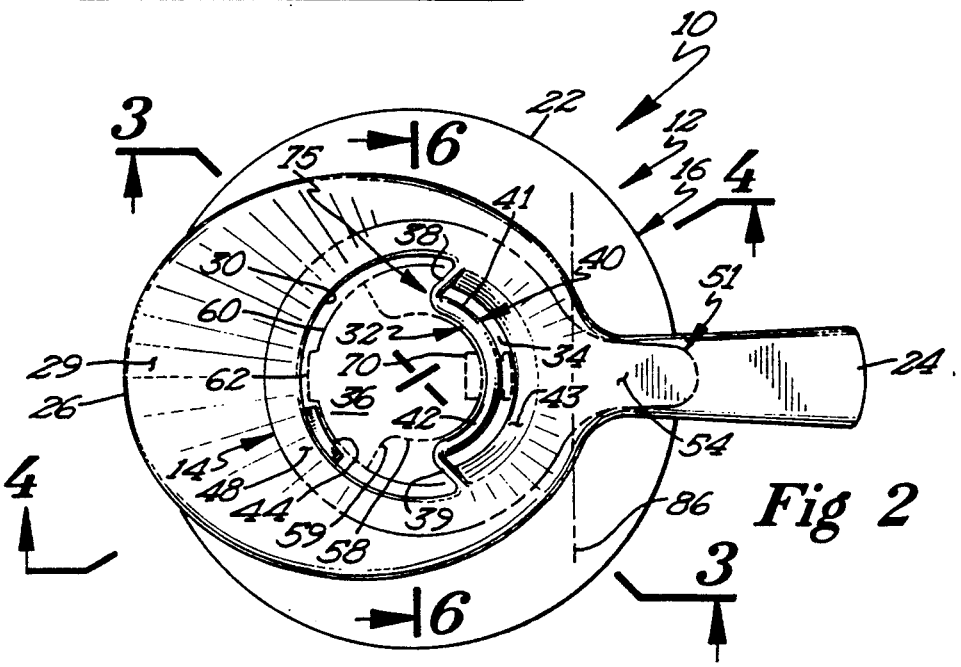
FIG. 2 illustrates the pitcher shown in FIG. 1 in a top plan view taken along plane 2—2 wherein the lid is shown in phantom in an operative position for pouring a beverage from the pitcher.
Figure 2A:
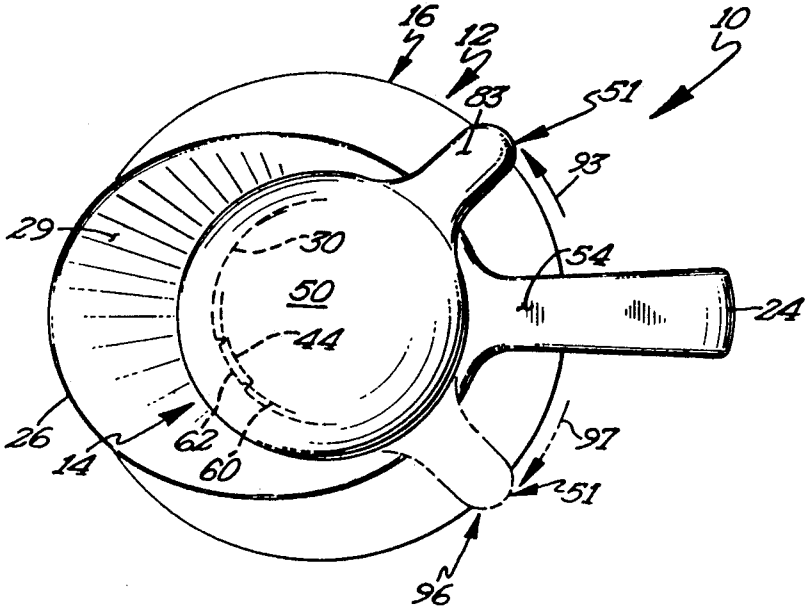
FIG. 2A illustrates from the same top plan view of FIG. 2 the beverage server of the present invention wherein the lid is shown rotated to the locked position and is shown in a phantom lines rotated to the filling position.

FIG. 1 illustrates a beverage server 10 in accordance with the present invention wherein server 10 includes a pitcher 12 and a lid 14. Pitcher 12 comprises a body portion 16 having a hollow interior 18 for containing a selected beverage. Body 16 may have a dual wall construction comprising an inner wall 20 and an outer wall 22. Insulation may be disposed between walls 20 and 22 to slow thermal conductivity between the beverage and the outside environment. Typically, pitcher 12 will include a handle 24 and a spout 26. As best seen in FIGS. 2 and 2A, spout 26 includes that portion of server 10 extending upwardly and outwardly from pitcher 12. Spout 26 includes a neck 28. A pouring surface 29 over which a beverage will flow when poured from the server 10 lies substantially diametrically opposite handle 24 on opposite sides of pitcher 12.

Figure 6:
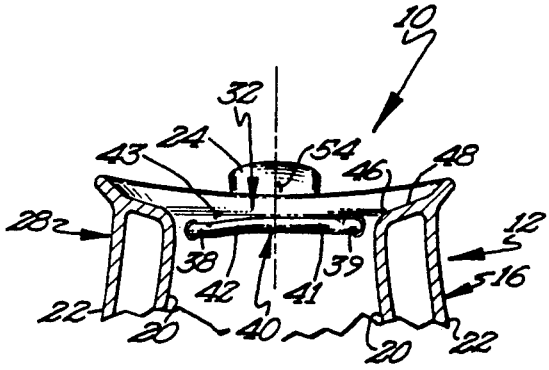
FIG. 6 illustrates the pitcher in a side elevation, cross section view taken along cutting plane 6—6 of FIG. 2.

As just noted, pitcher 12 is characterized in part by neck 28 that includes an opening 30. Opening 30 may have a substantially circular configuration. A guide rail generally indicated by reference numeral 32 extends substantially horizontally across opening 30 and divides opening 30 into an arcuate gap 34 and a spout opening 36, best seen in FIG. 2. Guide rail 32 includes a pair of support arms 38 and 39 that are attached at one end to neck 28 and that extend inwardly into opening 30. A cross member or rib 40 extends between the free ends of arms 38 and 39, as best seen in FIGS. 2 and 6. Member 40 preferably has an arcuate configuration that together with arms 38 and 39 define the arcuate configuration of gap 34. Member 40, as best seen in FIG. 6, includes a substantially horizontal portion 41 and a sloped portion 42. Sloped portion 42 is canted with respect to the horizontal, preferably at about a 3° angle. Sloped portion 42 aids in the camming and locking of the lid 14 onto pitcher 12 as will be described below.

Depending inwardly from spout 26 and downwardly into neck 28, generally, and into arcuate gap 34, particularly, is a shelf 43. Shelf or shoulder 43 generally conforms to the arcuate shape of rib 40 and defines therewith arcuate gap 34.

Figure 4:
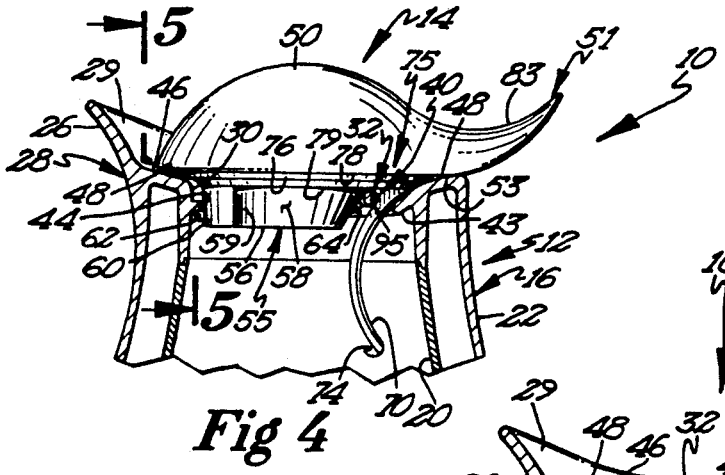
FIG. 4 illustrates the beverage server of the present invention wherein the pitcher is shown in a side elevation, cross sectional view taken along cutting plane 4—4 of FIGS. 2 and 2*a* and wherein the lid is shown disposed relative thereto in a sealingly engaging position and the locking lugs of the pitcher and lid are shown lockingly engaged.
Figure 5:
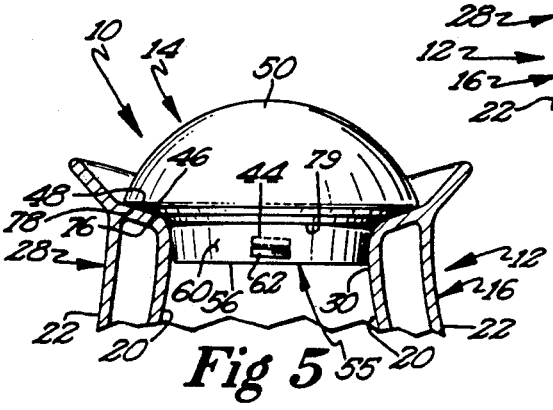
FIG. 5 illustrates the beverage server of the present invention wherein the pitcher is shown in a side elevation, cross sectional view taken along cutting plane 5—5 of FIG. 4, the lid is shown disposed relative thereto in a sealingly engaging position, and wherein the locking lug of the pitcher is shown in phantom engaged with the locking lug of the lid.

Referring now to FIGS. 2, 4 and 5, neck 28 further includes a neck lug 44 that extends inwardly into spout opening 36 and that has a camming and locking function. Neck lug 44 is radially offset from the center of pouring surface 29 so that it is positioned on the forward portion of neck 28 but not in alignment with a diameter drawn between the center of pouring surface 29 and pitcher handle 24. Neck lug 44 has a substantially elongate, arcuate, rectangular configuration and is slightly canted with respect to the horizontal, as best seen in FIG. 5. In a preferred embodiment, lug 44 is canted at about three degrees to the horizontal. The camming and locking function of neck lug 44 will be set out below. Spout 26 can also be characterized by several surfaces thereof that interact with lid 14. Thus, spout 26 includes a sealing surface 46 (FIG. 3) forming a seal seat disposed substantially coaxially with and circumferentially about opening 30. Surface 46 coacts with a lid seal 76 to be described below to seal opening 30 of server 10 and thereby prevent spillage. Spout 26 also includes a rest surface 48 disposed substantially coaxially with opening 30 and radially outward from surface 46. Lid 14 rotates upon surface 48 when disposed in its various multiple positions.

Figure 7:
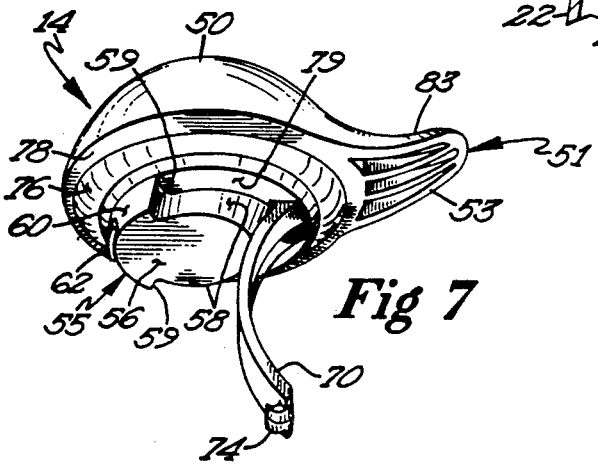
FIG. 7 depicts the lid of the beverage server shown in FIG. 1 in a perspective view from the underside thereof.

As shown most clearly in FIGS. 1 and 7, in a preferred embodiment lid 14 has a substantially circumferential configuration and includes a domed shaped cover 50 and a thumb handle 51 extending radially outwardly from cover 50. Thumb handle 51 is configured such that when lid 14 is placed on pitcher 12, a gap 52 will exist between the bottom surface 53 of handle 51 and the top surface 54 of handle 24.

Lid 14 further includes a stopple 55 extending downwardly from cover 50. Stopple 55 is configured to be received by spout opening 36 and comprises a stopple bottom 56 and stopple side walls 58, 59, and 60. Thus, walls 58 and 60 each have a substantially semicircular configuration of different diameters. Walls 58 and 60 are interconnected by walls 59. The diameter of walls 58 and 60 are chosen so that stopple 55 substantially conforms to the configuration of spout opening 36. Lid 14 further includes a counter lug such as stopple lug 62, which is configured substantially similarly to neck lug 44 but which is disposed at a slightly lower elevation than is neck lug 44. The relative elevations of lugs 44 and 62 are best seen in FIGS. 4 and 5. Stopple lug 62 is disposed on stopple wall 60 substantially directly opposite thumb handle 51. Lid 14 also includes a bead or boss 64 having a substantially hemispherical configuration extending outwardly from wall 58 of stopple 55. Bead or boss 64 is disposed directly opposite stopple lug 62 and aids in retaining lid 14 in position on pitcher 12. Bead or base 64 also aids in the locking function to be described below.

Figure 1A:
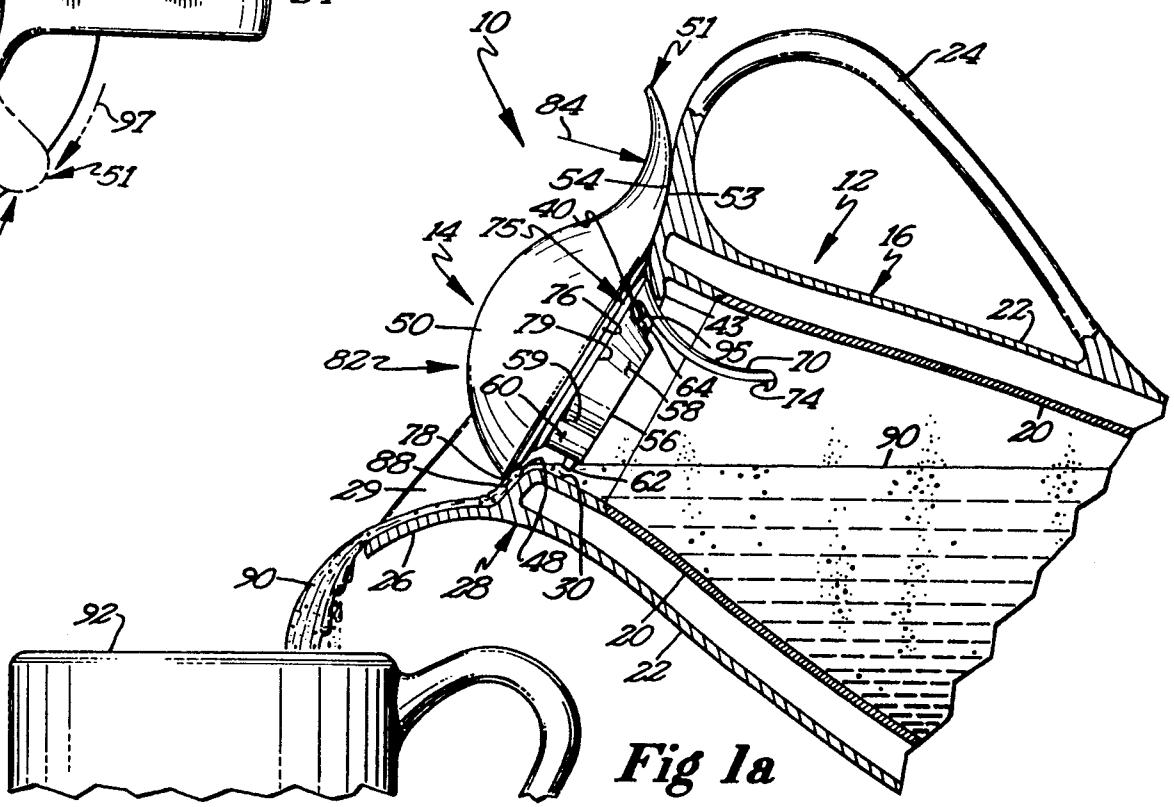
FIG. 1A illustrates the beverage server shown in FIG. 1 wherein the pitcher is shown is a side elevation, partial cross sectional view and with the lid opened for pouring a beverage into a drinking utensil.

Lid 14 further includes a substantially vertically disposed guide post 70. Guide post 70 is configured to be received within arcuate gap 34 when lid 14 is disposed on pitcher 12. Post 70 also has an arcuate configuration with the arc thereof being disposed inwardly substantially toward the middle of pitcher 12. Post 70 is spaced rearwardly from stopple wall 58 to define a gap 72, best seen in FIG. 3. When lid 14 is placed on pitcher 12 as shown in FIGS. 1, 1A and 4, rib member 40 of guide rail 32 is disposed within gap 72 as shown in those Figures. At its lower end post 70 includes a hook 74 as seen in the various Figures. Post 70 and bead 64 define a latch area 75 that receives member 40 when lid 14 is placed on pitcher 12. Post 70, along with bead or boss 64, provides a latching mechanism for retaining lid 14 on pitcher 12. Thus, the gap between bead 64 and post 70 is normally slightly less than the width of member 40, and when the lid 14 is placed on the pitcher 12, bead 64 and post 70 are slightly forced apart by the interference of member 40 therewith, with bead 64 and post 70 snapping back to normal positions as member 40 is received within latch area 75. Member 40 is thus slidably retained within latch area 75 to allow lid 14 to rotate relative to pitcher 12.

Lid 14 may further include a seal 76 extending substantially circumferentially around lid 14 as best seen in FIG. 7. When lid 14 is disposed on pitcher 12, coacting seal 76 and seal seat 46 may provide an effective seal against spillage of the beverage from the pitcher when lid 14 is in its locking position as best seen in FIGS. 4 and 5. A mating surface 78 is disposed on lid 14 to correspond with rest surface 48 of pitcher 12, thereby providing a pair of mutually engaging, slidably rotatable surfaces upon which lid 14 and pitcher 12 move relative to each other.

In operation, lid 14 is placed on pitcher 12 such that arcuate guide post 70 is disposed within arcuate gap 34.

Lid 14 is thus able to rotate around opening 30 by means of the slidable interaction of lid mating surface 78 on rest or spout mating surface 48 as well as the slidable reception of member 40 within latch area 75. Because stopple wall 58 has a lesser diameter than wall 60, the latter being substantially equal to that of opening 30, an unobstructed rotational region 79 (best seen in FIG. 7) is presented by the underside of lid 14 to arms 38 and 39. Had stopple 55 been chosen to conform exactly to the configuration of spout opening 36, rotation of lid 14 would have been impossible due to the immediate interference of stopple 55 with arms 38 and 39. The limits of rotation are prescribed by the interference of guide post 70 with arms 38 and 39 of guide rail 32 and by the interference of walls 59 with arms 38 and 39. Thus, in a preferred embodiment, lid 14 is rotatable between these limits so as to be capable of being disposed in three distinctly different, functional positions with respect to opening 30 as will now be explained.

In a first position, lid 14 is disposed in a pouring position 80. Thus, FIG. 1 shows lid 14 in a position 80 such that it may be pivoted open for pouring of a beverage from pitcher 12; FIG. 2 illustrates the relative non-interfering positions of lugs 44 and 62 when lid is disposed in position 80; and FIG. 1A shows lid 14 pivoted open in a pouring position 82. When placed in positions 80 and 82, lid 14 will be disposed with respect to opening 30 such that thumb handle 51 will lie directly above handle 24 of pitcher 12 as shown in FIGS. 1, 1A and 2. As previously indicated, bottom surface 53 of thumb handle 51 and top surface 54 of pitcher handle 24 define a gap 52. Exerting a downward force as indicated by arrow 84 on the top surface 83 of thumb handle 51, such as by means of a person's thumb, will cause lid 14 to pivot or rotate about an axis 86. Axis 86, as seen in FIG. 2, lies substantially perpendicular to thumb handle 51 and pitcher handle 24. It will be understood that axis 86 represents general axis about which the lid pivots and that axis 86 will in the present embodiment move rearwardly as thumb handle 51 is depressed. Thus, as lid 14 is pivoted, the side of lid 14 having stopple lug 62 will be lifted upwards while the side having thumb handle 51 will be lowered with respect to the opening 30. Lid 14 will pivot upwardly to a limit defined by the interference of thumb handle 51 with pitcher handle 24. In other words, lid 14 will pivot upwardly until gap 52 is substantially closed, as seen in FIG. 1A. Lid 14 will pivot on the top surface 54 of pitcher handle 24. In position 80, then, lid 14 is capable of opening to a sufficient extent to allow a beverage to be poured easily from pitcher 12. Lid 14 will open in response to force 84 so as to open a gap 88 between lid 14 and pouring surface 29, thereby allowing a beverage 90 to be poured from pitcher 12 into a beverage utensil such as a cup 92.

The second position of lid 14 will be explained with reference principally to FIGS. 2, 2A, 4 and 5. In its second position, lid 14 is rotated counterclockwise, as indicated by arrow 93, from its first position 80 as seen in FIG. 2 to the position 94 as shown in FIG. 2A. As lid 14 is rotated, stopple lug 62 begins to contact neck lug 44 of pitcher 12. As can be seen from FIG. 5, these lugs are each disposed at a slight angle with respect to a horizontal plane cutting through the pitcher. In a preferred embodiment, this angle is about three degrees. Additionally, bead or boss 64 will begin to contact the sloped portion 42 of guide rail 32. Further rotation of lid 14 on surface 48 will force stopple lug 62 beneath neck lug 44 and stopple bead or boss 64 beneath sloped portion 42 of guide rail 32 of pitcher 12 such that lid 14 will be cammed by lug 44 and guide rail sloped portion 42 into a locked and sealed position and prevented from tilting upwardly. As lug 62 is forced under lug 44, and bead or boss 64 is forced under sloped portion 42 of guide rail 40, lid 14 will be pressed tightly against pitcher 12. In particular, as lid 14 is rotated and forced downward by the interference of lugs 44 and 62 and by the interference of bead or boss 64 and sloped portion 42, seal 76 will sealingly engage sealing surface 46 of neck 28 such that any beverage contained within pitcher 12 will be unable to be spilled therefrom.

During the lid locking operation, forcing stopple lug 62 under neck lug 44 will tend to pivot the rear of lid 14 upwardly about a pivot axis defined by the interfering lugs. This upward pivoting of the lid is resisted by an interference between sloped portion 42 of guide rail 32 and bead or boss 64, as well as between member 40 and guide post 70. That is, the arcuate configuration of post 70 provides an interfering surface 95, best seen in FIGS. 3 and 4, that contacts member 40 and resists pivoting of lid 14 about the front thereof. Thus, a substantially uniform downward sealing force will be felt around the entirety of seal 72.

Figure 3:
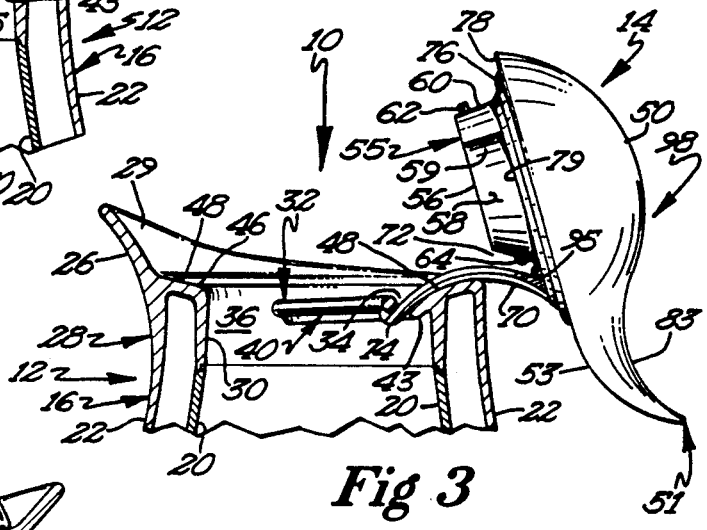
FIG. 3 illustrates the beverage server of the present invention wherein the pitcher is shown in a side elevation, cross sectional view taken along cutting plane 3—3 of FIGS. 2 and 2*a* and wherein the lid is shown disposed relative thereto in an operative position for filing the pitcher with a beverage.

Referring now principally to FIGS. 2, 2A, and 3 the third position 96 of lid 14 will be explained. In its third position, lid 14 is rotated clockwise, as indicated by arrow 97, from its first position 80 as shown in FIG. 2 to the position 96 as shown in FIG. 2A. After lid 14 is so rotated to position 96, thumb handle 51 and pitcher handle 24 will be placed in a noninterfering relationship with respect to each other. In addition, stopple lug 62 will be rotated to a position where it and neck lug 44 of pitcher 12 are not in interference. In position 96, exertion of a downward force on thumb handle 51 will pivot lid 14 completely open to the position 98 as shown in FIG. 3, thereby completely exposing spout opening 36 for easy filling of pitcher 12 with a beverage. As lid 14 is pivoted completely open, hook 74 of guide post 70 will catch upon member 40 of guide rail 32 to prevent lid 14 from being completely removed from pitcher 12. In such a position, post 70 will be supported by spout 26 and shelf 43, which is a continuation of spout 26 downwardly and inwardly into neck 28 and in particular, into arcuate gap 34.

Thus, because of the novel guide gap and guide post interactions, as well as the interactions of thumb handle 51 and pitcher handle 24, and stopple lug 62 and neck lug 44, lid 14 is capable of assuming three separate identifiable positions with respect to opening 30, all of which are quickly and easily obtained. The beverage server of the present invention provides an apparatus that allows easy filling of a desired beverage, easy pouring of the beverage from the server, and seals to prevent accidental spillage therefrom in a simple, quick and easy manner, namely, rotation of the lid on top of the pitcher by means of a thumb or finger.

The present invention having thus been described, other modifications, alterations, or substitutions' may now suggest themselves to those skilled in the art, all of which are within the spirit and scope of the present invention. By way of an example only, neck lug 44 could be disposed on neck 28 such that a clockwise rotation would seal the lid 14 to pitcher 12 and a counterclockwise rotation would allow lid 14 to be pivoted open so as to fill pitcher 12. It is therefore intended that the present invention be limited only by the scope of the attached claims below.

What is claimed is:

1. A beverage server comprising:

a pitcher; and a lid pivotally attachable thereto, wherein said pitcher includes:

a spout including a spout mating surface and a neck, said neck having an opening for filling said pitcher with a beverage and for pouring the beverage therefrom, said neck including:

a guide rail extending substantially horizontally across said opening to divide said opening into a guide gap and a spout opening; and wherein said lid includes:

a cover, a stopple attached to said cover, and a guide post attached to said cover, said cover including a lid engaging surface;

said stopple being configured to mate with said spout opening and to rotate therein, said guide post extending downwardly from said cover and configured for removable insertion into said guide gap when said lid is disposed on said pitcher such that said lid engaging surface slidably and rotatably engages said spout mating surface.

2. The beverage server of claim 1 wherein said neck includes a lug projecting inwardly into said neck opening and wherein said stopple of said lid includes a counter-lug projecting outwardly therefrom, said counter-lug of said stopple disposed thereon and configured so as to slide under said neck lug as said lid is slidably rotated on said neck and to exert a substantially upwardly directed force on said lug.

3. The beverage server of claim 2 wherein said stopple of said lid includes a boss projecting outwardly therefrom and said guide rail includes a sloped portion, said boss of said stopple disposed thereon and configured so as to slide under said sloped portion as said lid is slidably rotated on said neck and to exert a substantially upwardly directed force on said sloped portion.

4. The beverage server of claim 1 wherein said beverage server includes a pitcher handle having a top surface and said lid includes a thumb handle extending radially outward therefrom.

5. The beverage server of claim 4 wherein said neck includes a locking lug projecting inwardly into said neck opening and wherein said stopple of said lid includes a counter-lug projecting outwardly therefrom, said counter-lug of said stopple disposed thereon and configured so as to slide under said neck lug and to exert a substantially upwardly directed force as said lid is slidably rotated on said neck, wherein said lug of said stopple is disposed thereon opposite to said thumb handle.

6. The beverage server of claim 5 wherein said pitcher handle is an upright handle and said spout includes a spout pouring surface, said pitcher handle and said spout pouring surface being substantially aligned with a diameter of said opening, wherein said neck lug is disposed on said neck at a location thereon not in alignment with said diameter.

7. The beverage server of claim 6 wherein said lid is slidably rotatable on said pitcher neck to at least three separate positions including:

a first position wherein said thumb handle is disposed over said pitcher handle top surface and wherein exertion of a downward force on said thumb handle causes said lid to pivot on said pitcher handle top surface, said lid being pivotally openable to a pouring position for pouring a beverage from said pitcher, said pitcher handle interacting with said thumb handle during said pivoting motion to define a pivoting limit;

a second position wherein said lug of said stopple and said neck lug interact to prevent said lid from pivoting open; and a third position wherein said thumb handle and said pitcher handle are free of interaction and wherein said lugs are free of interaction, said lid being freely pivotable to a fully open position for filling or emptying said pitcher.

8. The beverage server of claim 7 wherein said second position is obtained by rotating said lid counterclockwise from said first position and wherein said third position is obtained by rotating said lid clockwise from said first position.

9. The beverage server of claim 1 wherein said guide rail comprises a pair of arms extending inwardly from said neck into said opening and an arcuate member extending between the free ends of said arms.

10. The beverage server of claim 1 wherein said lid further includes an elastomeric seal concentrically disposed thereon and said neck includes a seal seat disposed thereon, said seal and said seal seat capable of coacting to prevent accidental spilling of a beverage from said pitcher.

11. The beverage server of claim 10 wherein beverage server includes a pitcher handle having a top surface and said lid includes a thumb handle extending radially outward therefrom.

12. The beverage server of claim 11 wherein said neck includes a locking lug projecting inwardly into said neck opening and wherein said stopple of said lid includes a counter-lug projecting outwardly therefrom, said counter-lug of said stopple disposed thereon and configured so as to slide under said neck lug and to exert a substantially upwardly directed force as said lid is slidably rotated on said neck, wherein said lug of said stopple is disposed thereon opposite to said thumb handle.

13. The beverage server of claim 12 wherein said pitcher handle is an upright handle and said spout includes a spout pouring surface, said pitcher handle and said spout pouring surface being substantially aligned with a diameter of said opening, wherein said neck lug is disposed on said neck at a location thereon not in alignment with said diameter.

14. The beverage server of claim 13 wherein said lid is slidably rotatable on said pitcher neck to at least three separate positions including:

a first position wherein said thumb handle is disposed over said pitcher handle top surface and wherein exertion of a downward force on said thumb handle causes said lid to pivot on said pitcher handle top surface, said lid being pivotally openable to a pouring position for pouring a beverage from said pitcher, said pitcher handle interacting with said thumb handle during said pivoting motion to define a pivoting limit;

a second position where said lug of said stopple and said neck lug interact to prevent said lid from pivoting open, said seal and said seal seat co-acting to prevent a beverage from escaping from said pitcher when said lid is in said first position; and a third position wherein said thumb handle and said pitcher handle are free of interaction and wherein said lugs are free of interaction said lid being freely pivotable to a fully open position for filling or emptying said pitcher.

15. The beverage server of claim 14 wherein said second position is obtained by rotating said lid counter-clockwise from said first position and wherein said third position is obtained by rotating said lid clockwise from said first position.

16. The beverage server of claim 14 wherein said guide rail comprises a pair of arms extending inwardly from said neck into said opening and an arcuate member extending between the free ends of said arms.

17. The beverage server of claim 1 wherein:

said lid includes a thumb handle extending radially outward therefrom;

said spout includes a spout pouring surface and said pitcher handle is an upright handle having a top surface, said pitcher handle and said spout pouring surface being substantially aligned with a diameter of said opening; and wherein said lid is slidably rotatable on said pitcher neck to at least two separate positions including:

a first position wherein said thumb handle is disposed over said pitcher handle top surface and wherein exertion of a downward force on said thumb handle causes said lid to pivot on said pitcher handle top surface so that said lid is pivoted open to a pouring position for pouring a beverage from said pitcher, said pitcher handle interacting with said thumb handle during said pivoting motion to define a pivoting limit; and a second position wherein said thumb handle and said pitcher handle are free of interaction, said lid being freely pivotable to a fully open position for filling or emptying said pitcher.

18. A beverage server comprising:

a pitcher; and a lid pivotally attachable thereto, wherein said pitcher includes:

a spout including a spout mating surface and a neck, said neck having an opening for filling said pitcher with a beverage and for pouring the beverage therefrom; and a spout pouring surface and an upright handle having a top surface, said pitcher handle and said spout pouring surface being substantially aligned with a diameter of said opening;

wherein said lid includes:

a thumb handle extending radially outward therefrom; and wherein said lid is slidably rotatable on said pitcher neck to at least two separate positions including:

a first position wherein said thumb handle is disposed over said pitcher handle top surface, wherein exertion of a downward force on said thumb handle causes said lid to pivot on said pitcher handle top surface so that said lid is pivoted open to a pouring position for pouring a beverage from said pitcher, said pitcher handle interacting with said thumb handle during said pivoting motion to define a pivoting limit; and a second position wherein said thumb handle and said pitcher handle are free of interaction, said lid being freely pivotable to a fully open position for filling or emptying said pitcher.

19. The beverage server of claim 18 wherein said neck includes a lug projecting inwardly into said neck opening and wherein said lid includes a counter-lug projecting outwardly therefrom, said counter-lug of said lid disposed thereon and configured so as to slide under said neck lug as said lid is slidably rotated on said neck and to exert a substantially upwardly directed force on said neck lug.

20. The beverage server of claim 19 wherein said lid includes a boss projecting outwardly therefrom and said guide rail includes a sloped portion, said boss of said lid disposed thereon and configured so as to slide under said sloped portion as said lid is slidably rotated on said neck and to exert a substantially upwardly directed force on said sloped portion.

21. The beverage server of claim 20 wherein said lid lug is disposed thereon opposite to said thumb handle.

22. The beverage server of claim 21 wherein said pitcher includes an upright handle and said spout includes a spout pouring surface, said pitcher handle and said spout pouring surface being substantially aligned with a diameter of said opening, wherein said neck lug is disposed on said neck at a location thereon not in alignment with said diameter.

23. The beverage server of claim 20 wherein said lid is slidably rotatable on said pitcher neck to at least a third separate position, wherein at said third position said lid lug and said neck lug interact to prevent said lid from pivoting open.

* * * * *